United States Patent [19]

Ruff et al.

[11] Patent Number: 5,039,968

[45] Date of Patent: Aug. 13, 1991

[54] ROTOR SETTING ARRANGEMENT

[75] Inventors: Gerd Ruff, Heidelberg; Harald Knörrchen, Neckarsteinach, both of Fed. Rep. of Germany

[73] Assignee: Teldix GmbH, Heidelberg, Fed. Rep. of Germany

[21] Appl. No.: 392,978

[22] PCT Filed: Jan. 27, 1988

[86] PCT No.: PCT/EP88/00058

§ 371 Date: Aug. 2, 1989

§ 102(e) Date: Aug. 2, 1989

[87] PCT Pub. No.: WO88/05965

PCT Pub. Date: Aug. 11, 1988

[30] Foreign Application Priority Data

Jan. 28, 1987 [DE] Fed. Rep. of Germany ..... 3702417
Feb. 28, 1987 [DE] Fed. Rep. of Germany ..... 3706515
Sep. 18, 1987 [DE] Fed. Rep. of Germany ..... 3731348

[51] Int. Cl.[5] ..... H01F 7/08

[52] U.S. Cl. ..... 335/253; 333/106; 333/108; 335/254

[58] Field of Search ..... 335/253, 254, 272; 333/101, 105, 106, 108

[56] References Cited

U.S. PATENT DOCUMENTS 4,500,861 2/1985 Nelson ..... 335/254 X
4,633,201 12/1986 Ruff ..... 333/106
4,647,889 3/1987 Addis ..... 335/253

FOREIGN PATENT DOCUMENTS 0147610 7/1986 European Pat. Off. .
WO86/00405 1/1987 PCT Int'l Appl. .
WO87/00165 10/1987 PCT Int'l Appl. .

*Primary Examiner*—George Harris
*Attorney, Agent, or Firm*—Spencer & Frank

[57] ABSTRACT

A system for setting in particular the rotor (2) of a coaxial or waveguide switch in n possible locking positions $S_1$, $S_2$, $S_3$, . . . has an axially staggered drive on one side and on the opposite side a locking means (6, 7, 8/9, 10/11, 12). On the side facing the stator, the drive (3, 4, 5) has a drive winding composed of the drive coils (5) connected to only one pair of conductors by means of which a current of a determined polarity is supplied to the drive winding (5) and which turns the rotor (2) in the direction of the n locking positions $S_1$, $S_2$, $S_3$, . . . by means of magnetic forces. The main purpose of the locking means (6, 7, 8/9, 10/11, 12) is to turn the rotor (2) into the exact locking position and to maintain it in that position.

11 Claims, 6 Drawing Sheets

ROTOR SETTING ARRANGEMENT

This invention relates to an arrangement for setting a rotor into n possible positions.

WO 87/00,349 discloses a moving arrangement for setting the rotor of a high-frequency switch into predetermined switching positions. In this moving arrangement, at least two electrically actuatable coils are arranged on the side of the stator and at least one permanent magnet on the side of the rotor in such a manner that actuation of the coils causes the rotor to be moved at least approximately into the predetermined switching positions. A deceleration element is provided which operates without contact to brake the movement of the rotor in the vicinity of the predetermined switching position.

EP-A3 0,147,610 discloses a waveguide switch having, in particular, four rotor positions. The rotor of this waveguide switch is rotated by means of a stepping motor into the vicinity of a desired switching position. Permanent-magnet forces of a detent member center the rotor in an exact switching position as predetermined by the detent member.

It is the object of the invention to provide an arrangement for setting the rotor of a rotary switch into n possible positions, wherein the actuation of the drive coils is effected through as few conductors as possible and the arrangement nevertheless has a simple, compact structure.

In the arrangement according to the invention, all drive coils are actuated only through the same conductor pair. An auxiliary position is provided between the individual detent positions and, in each case, lies closer to the initial position than to the next following position. The permanent magnets of the detent arrangement on the side of the rotor and stator have an associated, oppositely polarized lower field intensity permanent magnet which is offset by such an angle that, in the auxiliary position, once the drive system has been turned off, a moment driving in the direction of the next following position, rotates the rotor into the next following position and centers it there. The axes of the adjacent drive coils enclose an angle of 360°/n or 360°/2n.

Further advantages and features become evident from the dependent claims and the specification. The tapering of the detent magnets results in more accurate positioning of the rotor and the additional drive winding realizes, in particular, faster switching of the rotor into the next switching position. The damping device causes the rotor to come to rest in the detent positions without overshooting and pendulum action.

The invention will now be described in greater detail with reference to three embodiments.

Figure 1B:
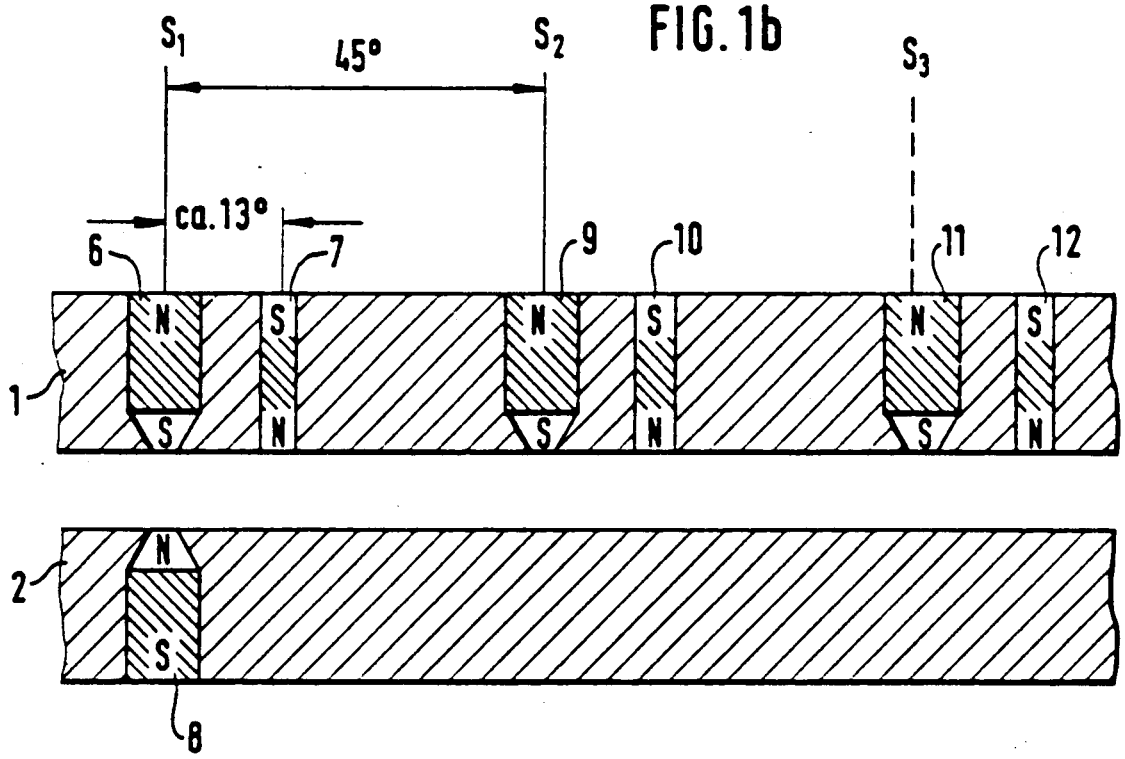
Figure 1A:
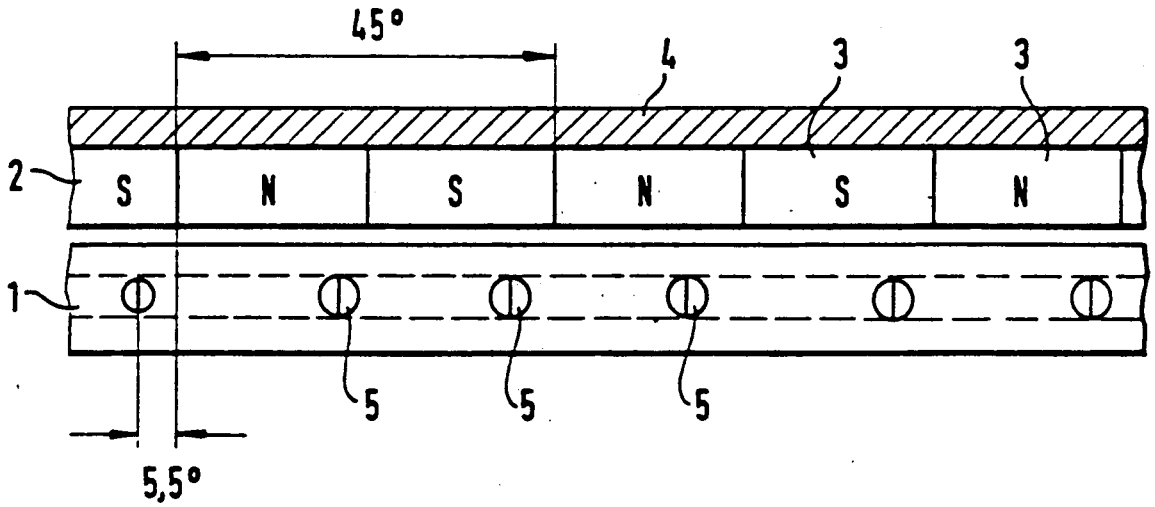
Figure 2:
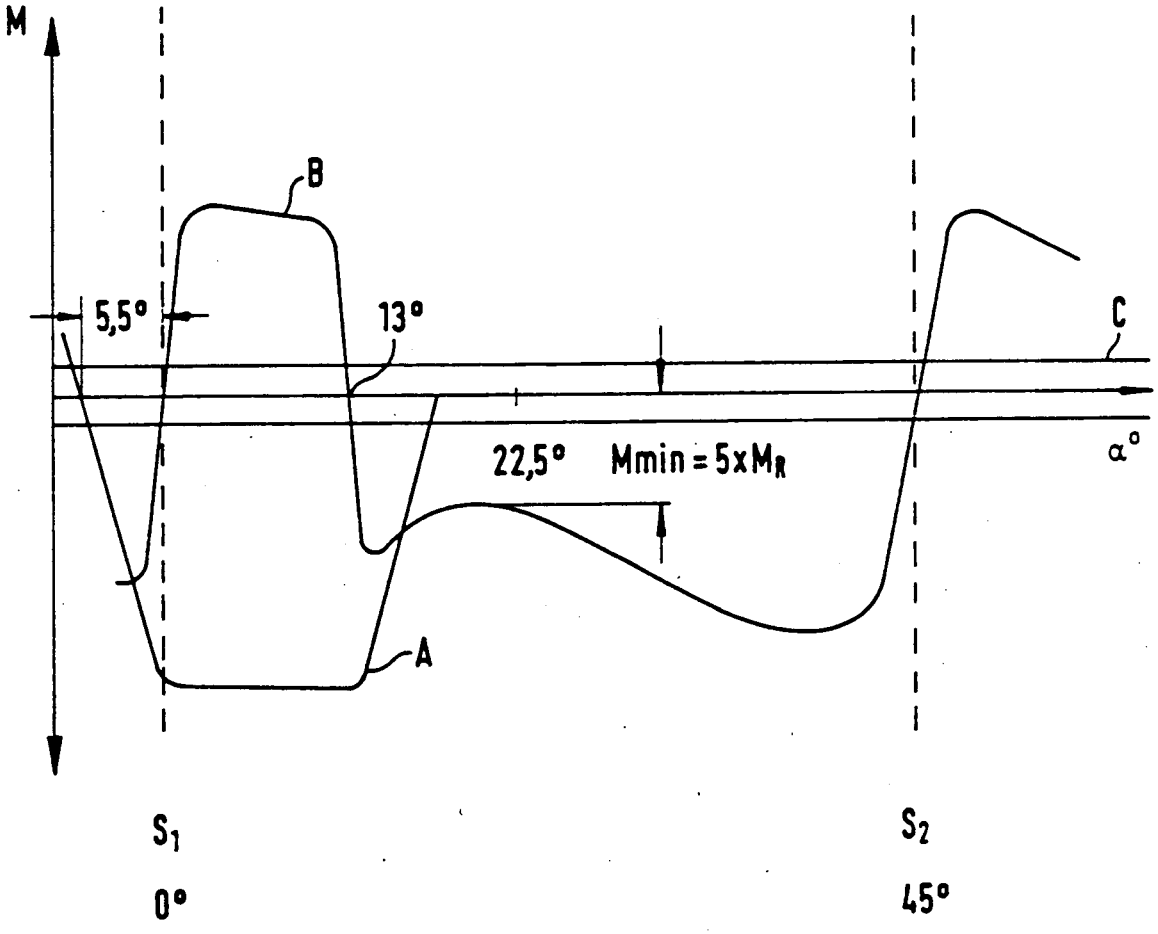
Figure 3B:
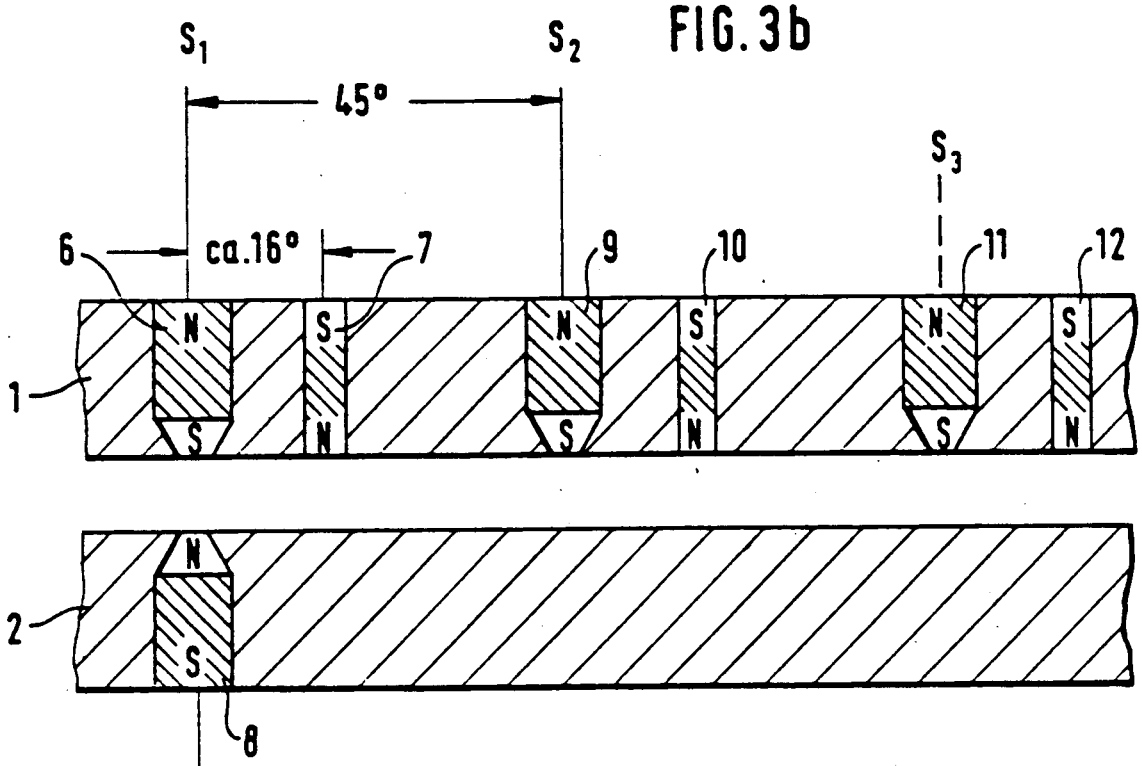
Figure 3A:
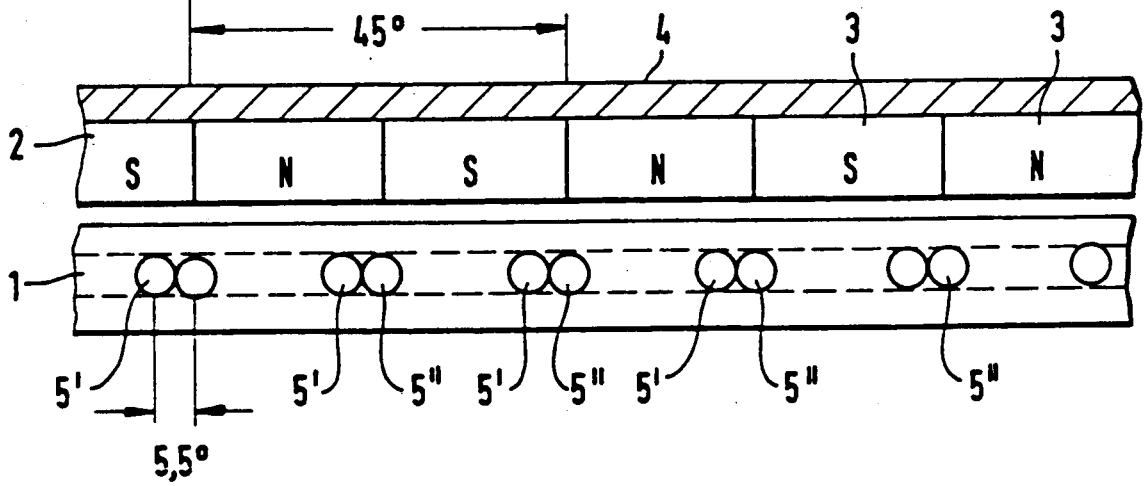
Figure 4:
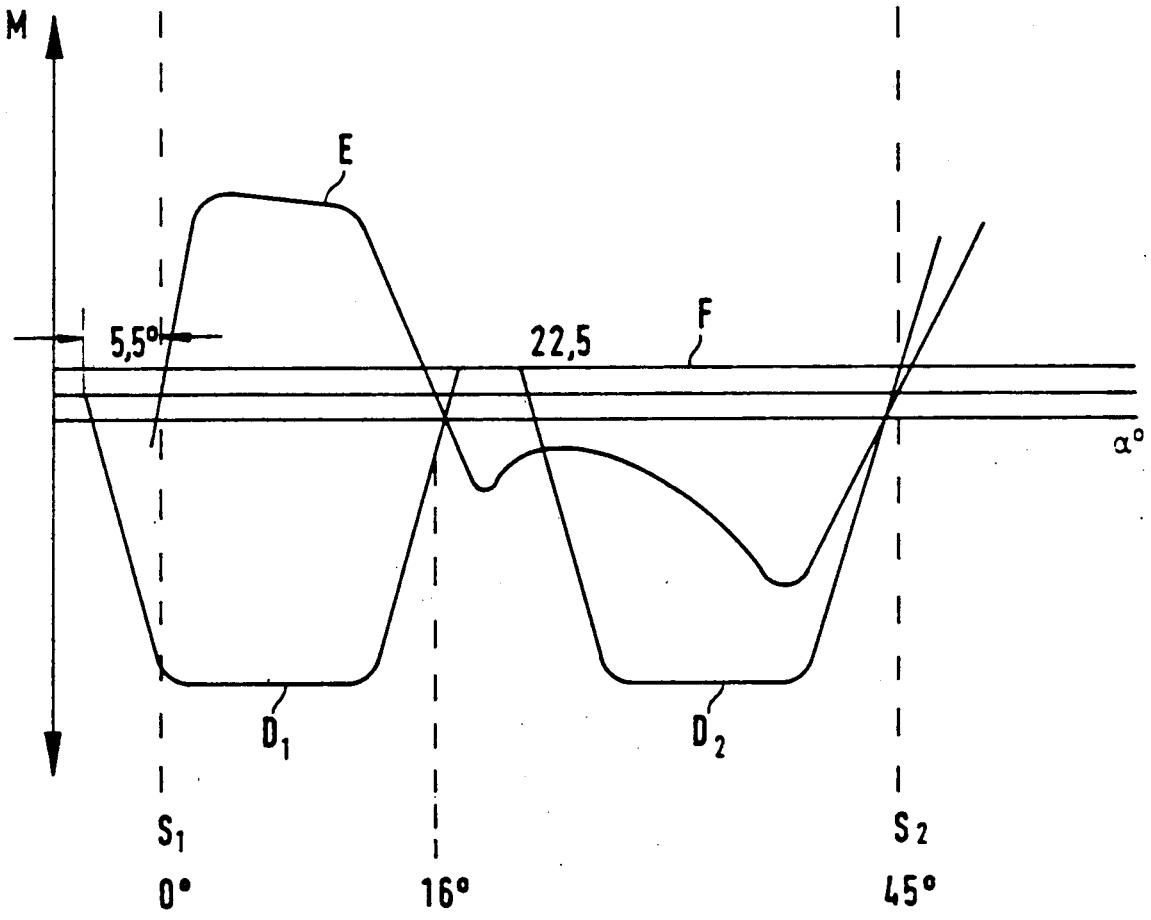
Figure 5:
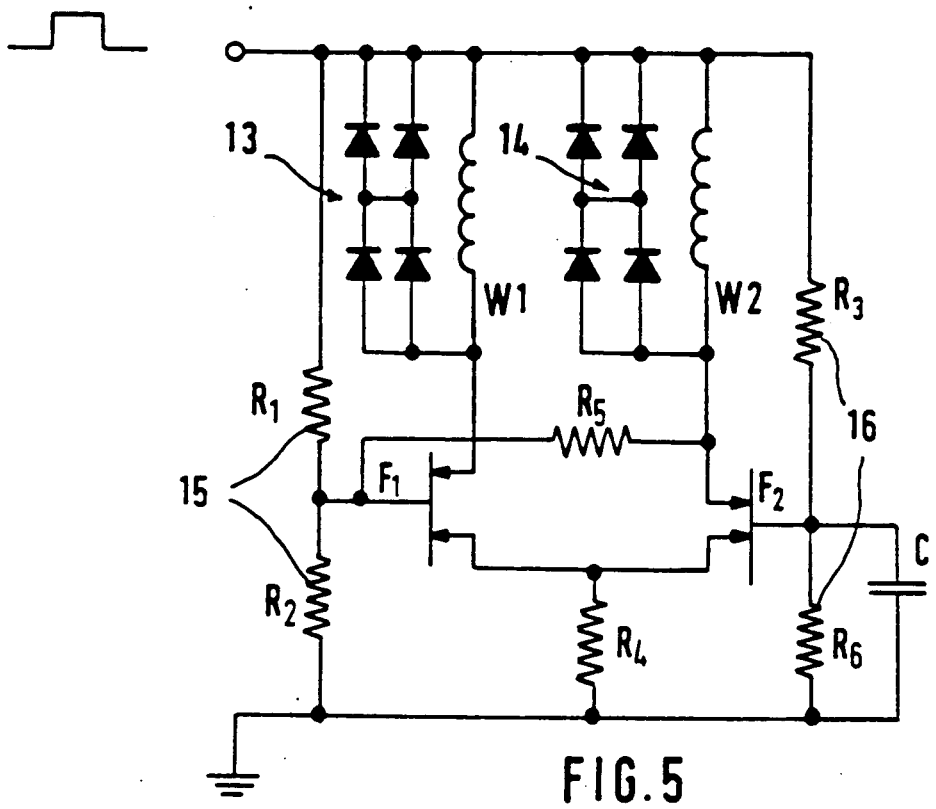
Figure 6:
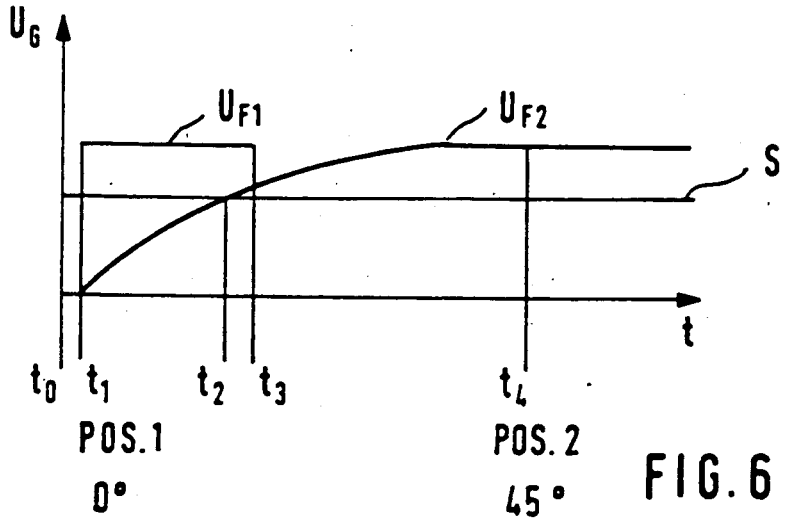
Figure 7:
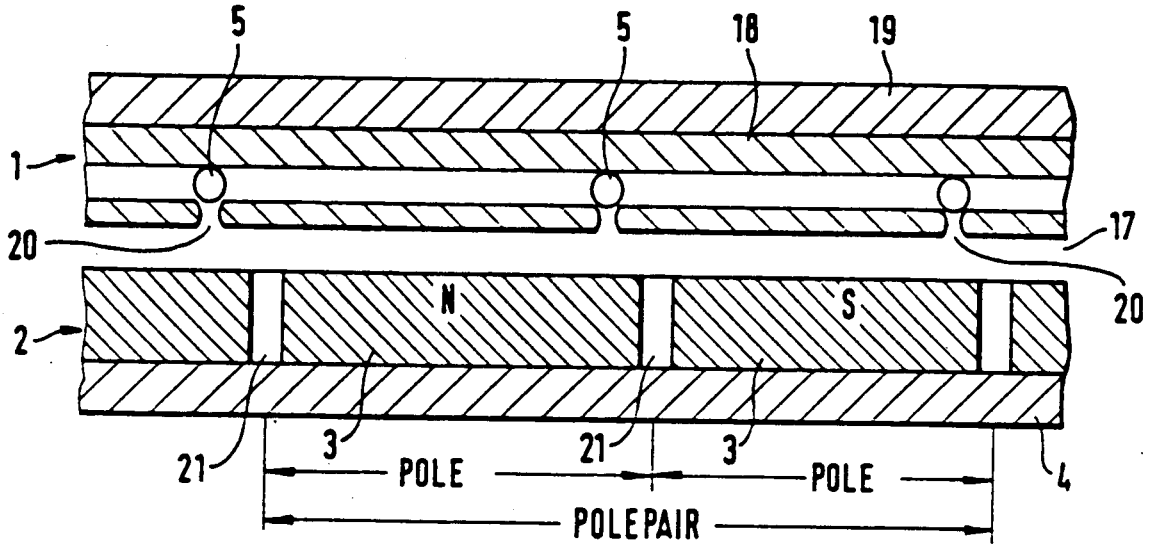

It is shown in:

FIG. 1, an elementary diagram, in a developed view, of part of an arrangement for eight switching positions;

FIG. 2, the moment characteristics of the developed view of FIG. 1;

FIG. 3, a further embodiment of the invention including a further drive winding;

FIG. 4, the moment characteristics of the further embodiment of the invention shown in FIG. 3;

FIG. 5, a circuit diagram of the deceleration member required for the further embodiment of the invention including two drive windings W1 and W2;

FIG. 6, voltage characteristics for the deceleration member shown in FIG. 5;

FIG. 7, part of the basic structure, in a developed view, of an integrated damping device that can be used in an arrangement similar to FIG. 1*a* and in a further embodiment similar to FIG. 3*a;*

Figure 8:
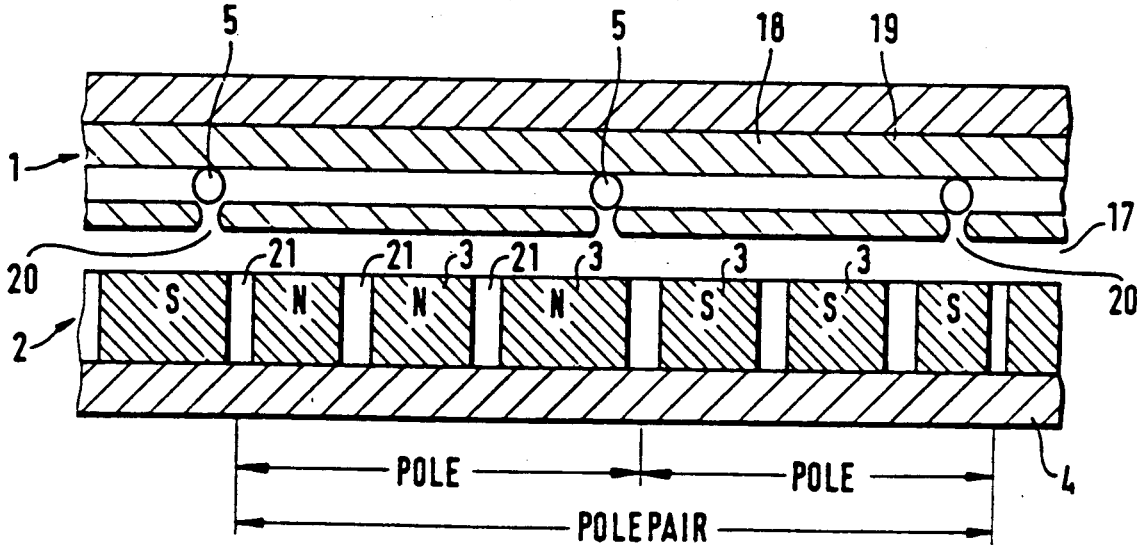

FIG. 8, part of the basic structure, in a developed view, of a modification of the integrated damping device that could be used in an arrangement similar to FIG. 1*a* and in a further embodiment similar to FIG. 3*a*.

The arrangement according to FIG. 1 comprises, in FIG. 1*a*, a drive including a stator 1 and a rotor 2 for eight switching positions as it could be used, for example, to switch coaxial or waveguide switches. The stator 1 composed of a plastic body includes a drive winding of 2n series and/or parallel connected drive coils 5, here symbolically indicated as single conductors shown in section in a developed view. The winding arrangement is offset by about 5.5° from the detent position $S_1$ relative to the contact faces between the magnets of rotor 2 so as to receive a defined moment of rotation in a certain direction at the instant of current flow through the winding. driving moment $M_A$ (curve A) is effected by detent arrangement 6, 7, 8/9, 10/11, 12.

Beginning at about 13°, detaining moment $M_D$ (curve B) is added to the driving moment $M_A$ (curve A) and, if current continues to be present, rotor 2 is rotated beyond 13°. Here, the current can be turned off. Now only detaining moment $M_D$ (curve B) is effective, which in this region is greatly determined by the effect of magnets 7 and 8 and reaches its lowest value in a region of about 22° but still is about five times greater than, for example, the friction moment $M_R$ (curve C) produced by bearing friction. Detaining moment $M_D$ (curve B) which increases until about 40°, drives rotor 2 in the direction of detent position $S_2$. Beginning at about 40°, detaining moment $M_D$ (curve B) decreases steeply and becomes zero at 45°. Magnets 8 and 9 of detent arrangement 6, 7, 8/9, 10/11, 12 now are disposed opposite one another (detent position $S_2$).

If rotor 2 is to be turned to the next detent position ($S_3$), a new current pulse of the same polarity is needed in the same conductor pair.

FIGS. 3 to 6 show a further embodiment of the invention. FIG. 3*a* shows a drive including a stator 1 and a rotor 2 for eight switching positions. Stator 1 includes two drive windings comprising two times eight parallel and/or series connected drive coils 5', 5'', which are likewise shown symbolically as sectionally viewed single conductors in a developed view. The first drive winding including coils 5' is likewise moved about 5.5° out of detent position $S_1$, $S_2$, $S_3$ . . . relative to the contact faces between the magnets of rotor 2, while the second drive winding including coils 5'' is offset by about 28° relative to the first drive winding, in order to obtain, by delayed actuation of the second drive winding, a driving moment of the same magnitude and the same direction of rotation. The two drive coils produce the same magnetic poles in succession.

Rotor 2 includes permanent magnet pairs 3, each offset by 45°, whose poles alternate in succession, as well as a magnetic yoke 4.

FIG. 3*b* shows part of detent arrangement 6, 7, 8/9, 10/11, 12. As in embodiment 1, detent arrangement 6, 7, 8/9, 10/11, 12 is disposed on rotor 2 and on stator 1. The only difference from the first embodiment is the arrangement of the lower field intensity magnets 7, 10, 12, which are now offset by about 16 relative to permanent magnets 6, 9, 11.

FIG. 4 shows the moment characteristics for the second embodiment. Here, curve $D_1$ shows the course of driving moment $M_{A1}$ of the first drive winding in a range from detent position $S_1$ to about 19°. Curve $D_2$ shows the path of driving moment $M_{A2}$ of the second drive winding in a range from about 19° to detent position $S_2$.

Curves E and F represent the course of detaining moment $M_D$ and of friction moment $M_R$.

At the moment of turn-on, a current pulse causes the first drive winding to generate a driving moment $M_{A1}$ according to curve $D_1$ which drives the rotor out of its detent position $S_1$ in the direction of the next detent position $S_2$. Driving moment $M_{A1}$ (curve $D_1$) of the first drive winding reaches a value of zero at about 17°. Detent arrangement 6, 7, 8 opposes this driving moment $M_{A1}$ (curve $D_1$) with an oppositely directed detaining moment $M_D$ (curve E) that is small relative to driving moment $M_{A1}$ (curve $D_1$) and becomes zero at about 16°. Approximately at this point, the first drive winding is turned off. Beginning at about 16°, a moment exists which is directed in the same direction as driving moment $M_{A1}$ (curve $D_1$). By turning on the second drive winding with a time delay, a driving moment $M_{A2}$ (curve $D_2$) results which is added to detaining moment $M_D$ (curve E). Both moments reach the value of zero at 45°. The moving mass of rotor 2 overcomes the zero point of the moments at about 16°. Detaining moment $M_D$ (curve E) moves the rotor from about 18° in the direction of detent position $S_2$ until, at 22.5°, the driving moment $M_{A2}$ (curve $D_2$) of the second drive winding (coils 5″) takes over and together with detaining moment $M_D$ (curve E) turns rotor 2 into detent position $S_2$ aligning it there by way of the reversing moments. The current through the second drive winding (coils 5″) may be turned off after rotor 2 has been aligned. Detent magnets 9, 8 hold rotor 2 in detent position $S_2$.

Further rotation of rotor 2 from detent position $S_2$ into the next detent position $S_3$ occurs in the same manner by means of a further current pulse of the same polarity on the same conductor pair.

FIG. 5 shows a circuit connected with only one conductor pair for a deceleration member including two drive windings $W_1$ and $W_2$ as it is required for the further embodiment of the invention.

At time $t_0$ (FIG. 6), a current pulse at the input of the circuit produces, via the resistor $R_1$ of a voltage divider 15, a voltage drop which is fed to the gate of a field effect transistor $F_1$ and makes the latter conductive at time $t_1$ (FIG. 6). With field effect transistor $F_1$ conductive, a current flows through drive winding $W_1$ and generates a driving moment $M_{A1}$ according to curve $D_1$ (FIG. 4). The above-mentioned current pulse is also applied, via the resistor $R_3$ of a voltage divider 16, to a capacitor C and charges it according to the function $U_{F2}$ (FIG. 6). As soon as the charge state of capacitor C reaches the switching threshold S of a field effect transistor $F_2$ at time $t_2$, field effect transistor $F_2$ becomes conductive and the current flowing through drive winding $W_2$ generates a driving moment $M_{A2}$ according to curve $D_2$ (FIG. 4). Via resistors $R_4$ and $R_5$, field effect transistor $F_1$ is switched off as soon as ($t_3$) field effect transistor $F_2$ has become conductive. Diode arrangements 13 and 14 serve to protect field effect transistors $F_1$, $F_2$ during the rapid turn-off of currents through windings $W_1$ and $W_2$.

FIGS. 7 and 8 show the drive in a further embodiment of the invention. FIG. 7 is a developed view of part of the basic structure of an integrated damping device employed in an arrangement similar to FIG. 1*a* and in a further embodiment similar to FIG. 3*a*.

The significant features of a damping device integrated magnets 3 which are disposed on the side of the rotor and are separated from one another by narrow air gaps 21; the drive winding disposed on the side of the stator in a coil carrier element 18 made of an electrically well conducting material (e.g. aluminum); and the magnetic yoke 19 on the side of the stator.

In FIG. 7, a rotor connected with a rotor element of a coaxial or waveguide switch (not shown) is marked 2. In order to form a homogeneous magnetic field in air gap 17, permanent magnets 3 of different polarization directions are arranged in uniform distribution over the surface of rotor 2. Two adjacent permanent magnets of different polarities, which are separated from one another by narrow air gaps 21, form a magnet pole pair 3. Radially to the side facing away from stator 1, there is disposed a magnetic yoke 4 of a soft magnetic material in order to reduce the magnetic resistance of the magnet arrangement. Air gap 17 is radially defined by a coil carrier element 18 on the side of the stator which, depending on the required number of switching positions, includes a different number of drive coils 5. Coil carrier element 18 on the side of the stator is constructed of electrically well conducting material (e.g. aluminum) in which drive coils 5, here shown as simple conductors, are embedded. This coil carrier element 18 of stator 1 is likewise delimited radially outwardly toward the side facing away from rotor 2 by a magnetic yoke 19 of a soft-magnetic material.

In the switching positions opposite air gaps 21 of rotor 2, drive coils 5 are arranged with a slight offset, so as to immediately produce the maximum driving moment at the instant they are switched out of the switching positions.

If current flows through drive coils 5, they together with permanent magnets 3 of rotor 2 generate a magnetic field which drives rotor 2 and causes it to rotate. The rotary movement of rotor 2 produces an eddy current in the electrically well conducting material of coil carrier element 18 and thus a magnetic field which is directed in such a way that it weakens the original magnetic field of permanent magnets 3. Thus a decelerating effect is obtained which continues as long as rotor 2 is in motion. The decelerating effect is great if the rotor moves fast and the decelerating effect is small if the rotor moves slowly.

The effect of the eddy current brake is supported by a detent arrangement as described in connection with FIG. 1.

FIG. 8 shows the basic structure of a further embodiment of such an arrangement. The decisive difference from the structure of the arrangement according to FIG. 7 lies in the configuration of rotor 2.

The poles of permanent magnets 3 are subdivided into several magnets of the same polarity and are arranged so as to be separated from one another by narrow air gaps 21.

With this arrangement it is accomplished that a seeming increase in the number of poles produces greater eddy currents. The moment generated by the eddy current impedes the movement of rotor 2. During rotation of rotor 2 of the arrangement and the rotor of a coaxial or waveguide switch (not shown) connected therewith, the seeming increase in the number of poles of rotor 2 produces a lower rotational velocity for rotor 2 between switching positions so that rotor 2 need be braked from a lower rotational velocity before rotor 2 reaches the switching positions and thus the rotor is stopped more quickly in the switching position.

LIST OF REFERENCE NUMERALS

1 stator
2 rotor
3 permanent magnets, drive, on the side of the rotor
4 magnetic yoke of the rotor
5 drive coil, on the side of the stator
5' drive coil, on the side of the stator
5'' drive coil, on the side of the stator
6, 7, 8, 9, 11 detent arrangement
6, 8 detent magnets
7, 10, 12 lower field intensity permanent magnet
9, 10 detent arrangement
11, 12 detent arrangement
13 protective diodes for $F_1$
14 protective diodes for $F_2$
15 voltage divider
16 voltage divider
17 air gap
18 coil carrier element
19 magnetic yoke of stator
20 groove
21 air gap
$S_1$ detent position $S_1$
$S_2$ detent position $S_2$
$S_3$ detent position $S_3$
curve A driving moment $M_A$
curve C friction moment $M_R$
curve $D_1$ driving moment $M_{A1}$ produced by drive winding 1
curve $D_2$ driving moment $M_{A2}$ produced by drive winding 2
E detaining moment $M_D$
F friction moment $M_R$
$F_1$, $F_2$ field effect transistors 1, 2
C capacitor 1
$R_1$, $R_2$, $R_3$, $R_4$, $R_5$, $R_6$ resistor
$W_1$ drive winding $W_1$
$W_2$ drive winding $W_2$

We claim:

1. Arrangement for setting the rotor of a rotary switch into n possible positions, wherein (1) a drive system composed of n uniformly distributed drive windings on the side of the stator and nor 2n permanent magnets which are uniformly distributed on the side of the rotor is actuated briefly for the purpose of effecting this setting, so as to rotate the rotor from its momentary position (starting position) into an auxiliary position; wherein (2) in the individual detent positions, the drive coils and the permanent magnets of the drive on the side of the rotor are offset relative to one another by a small angle so that a moment of rotation in only one defined direction is generated when the drive current is turned on; and wherein (3) in the auxiliary position, a detent arrangement is employed which includes n permanent magnets on the side of the stator, with all poles facing the rotor having the same polarity and, on the side of the rotor, at least one permanent magnet which, facing the stator, has the opposite polarity so as to produce a curve for the magnetic detaining moment which, after the drive system has been turned off, centers the rotor in the respectively next following position, characterized in that all drive coils are actuated only through the same conductor pair; the auxiliary position always lies closer to the initial position than to the next following position; the permanent magnets (6, 8/9/11) of the detent arrangement on the side of the rotor and stator have an associated lower field intensity permanent magnet (7/10/12) which is polarized oppositely to the stator side permanent magnets (6, 9, 11) of the detent arrangement and is offset by such an angle that, in this auxiliary position, after the drive system has been turned off, a driving moment in the direction of the next following position rotates the rotor (2) into the next following position and centers it there, with the axes of adjacent drive coils enclosing an angle of 360°/n.

2. Arrangement for setting the rotor of a rotary switch into n possible positions, wherein (1) a drive system composed of 2n uniformly distributed drive windings on the side of the stator and n or 2n permanent magnets which are uniformly distributed on the side of the rotor is actuated briefly for the purpose of effecting this setting, so as to rotate the rotor from its momentary position (starting position) into an auxiliary position; wherein (2) in the individual detent positions, the drive coils and the permanent magnets of the drive on the side of the rotor are offset relative to one another by a small angle so that a moment of rotation in only one defined direction is generated when the drive current is turned on; and wherein (3) in the auxiliary position, a detent arrangement is employed which includes n permanent magnets on the side of the stator, with all poles facing the rotor having the same polarity and, on the side of the rotor, at least one permanent magnet which, facing the stator, has the opposite polarity so as to produce a curve for the magnetic detaining moment which, after the drive system has been turned off, centers the rotor in the respectively next following position, characterized in that all drive coils are actuated only through the same conductor pair; the auxiliary position always lies close to the initial position than to the next following position; the permanent magnets (6, 8/9/11) of the detent arrangement on the side of the rotor and stator have an associated lower field intensity permanent magnet (7/10/12) which is polarized oppositely to the stator side permanent magnets (6, 9, 11) and is offset by such an angle that, in this auxiliary position, after the drive system has been turned off, a driving moment in the direction of the next following position rotates the rotor (2) into the next following position and centers it there, and the adjacent drive coils generate oppositely directed magnetic fields, with the axes of adjacent drive coils enclosing an angle of 360°/2n.

3. Arrangement according to claim 1, characterized in that, on the side of the rotor, the drive includes a magnetic yoke (4).

4. Arrangement according to claim 1, characterized in that at least one of the contact faces between the permanent magnets (3) of the drive on the side of the rotor is located in the respective detent position ($S_1$, $S_2$, $S_3$, . . . ), and the drive coils (5) on the stator side exhibit a small angular offset relative to these contact faces between the permanent magnets (3) of the rotor (7).

5. Arrangement according to claim 1, characterized in that the permanent magnets (3) on the rotor side of the drive are slightly angularly offset relative to the detent position ($S_1$, $S_2$, $S_3$, . . . ) of the rotor (2), while at least one side of one of the drive coils (5) on the stator side is in the detent position ($S_1$, $S_2$, $S_3$).

6. Arrangement according to claim 1, characterized in that the detent magnets (6, 8/9/11) are tapered on their sides facing one another.

7. Arrangement according to claim 1, characterized in that the lower field intensity magnets (7, 10, 12) of the detent arrangement (6, 7, 8/9, 10/11, 12) are offset relative to the detent magnets (6, 8/9, 11) by about 360°/3.5n in the direction opposite to the direction of rotation.

8. Arrangement according to one of claim 1, characterized in that the first drive winding formed by the drive coils (5') includes an associated further drive winding formed by the drive coils (5''), with said further drive winding being offset in such a manner that, in the detent positions ($S_1$, $S_2$, $S_3$, . . . ), no driving moment ($M_{A1}$, $M_{A2}$) is generated if current flows through this further drive winding (5''); the coils of the further drive winding (5'') are connected in parallel or in series with a deceleration member which, in turn, is connected with the conductor pair; and the time delay imparted by the deceleration member is designed in such a way that the further drive winding (5'') becomes effective once the rotor (2) has reached a position in which a drive moment ($M_{A2}$) is exerted onto rotor (2) by the further drive winding (5'') in the same direction of rotation as it had been exerted earlier by the first drive winding (5'), thus causing the first drive winding to then be free of current.

9. Arrangement according to one of claim 1, characterized in that, in order to construct an eddy current brake, the stator (1) of the drive system is made of electrically well conducting material (coil carrier element 18) on the side opposite the permanent magnet (3) and the coils (5) are at least partially embedded in this material.

10. Arrangement according to claim 9, characterized in that the coils (5) are inserted in grooves (20).

11. Arrangement according to claim 9, characterized in that the permanent magnets (3) are composed of a plurality of magnets of the same polarization.

* * * * *